US005485890A

United States Patent [19]

Cawthorne et al.

[11] Patent Number: 5,485,890

[45] Date of Patent: Jan. 23, 1996

[54] ROCK BIT

[75] Inventors: Chris E. Cawthorne; Steve Peterson, both of The Woodlands, Tex.; Naresh J. Kar, Westminster, Calif.; Madapusi K. Keshavan, The Woodlands, Tex.

[73] Assignee: Smith International, Inc., Houston, Tex.

[21] Appl. No.: 416,484

[22] Filed: Apr. 4, 1995

Related U.S. Application Data

[63] Continuation of Ser. No. 259,433, Jun. 14, 1994, abandoned.

[51] Int. Cl.[6] ..... E21B 10/22

[52] U.S. Cl. ..... 175/228

[58] Field of Search ..... 175/227, 228, 175/229, 371; 277/170, 177, 186; 384/94

[56] References Cited

U.S. PATENT DOCUMENTS

| | | | |
|---|---|---|---|
| 3,879,094 | 4/1975 | Tschirky et al. | 384/91 X |
| 3,896,244 | 7/1975 | Ellis et al. | 427/451 |
| 4,029,368 | 6/1977 | Tschirky et al. | 384/97 |
| 4,747,604 | 5/1988 | Nakamura | 277/170 X |
| 4,934,467 | 6/1990 | Langford, Jr. | 175/371 |
| 5,005,989 | 4/1991 | Karlsson | 384/94 |

OTHER PUBLICATIONS

"Twice the Abrasive Wear Resistance and More", 5 pages, Praxair Surface Technologies, Inc.

John M. Quets, 45th Annual Forum and Technology Display, American Helicopter Society "SDG 2040, a Novel Wear Resistant Coating for Aircraft Structural Components" May, 1989. 7 pages.

"UCAR Metal & Ceramic Coatings Physical Characteristics", Praxair Surface Technologies, 4 pages.

"Hard Facts–Praxair Surface Technologies Detonation Gun Process" raxair Surface Technologies, 2 pages.

"Application Highlights–Petroleum Industry"–Union Carbide Coatings Service, 4 pages.

"Union Carbide Coatings Service"–Praxair Surface Technologies, Inc. 10 pages.

*Primary Examiner*—William P. Neuder

*Attorney, Agent, or Firm*—Christie, Parker & Hale

[57] ABSTRACT

A rock bit for drilling subterranean formations has an improved dynamic O-ring seal for retaining lubricant around the rock bit bearings during operation of the rock bit. Such a bit has a plurality of journal pins, each having a bearing surface, and a cutter cone mounted on each journal pin and including a bearing surface. A grease reservoir is in communication with such bearing surfaces for maintaining grease adjacent to the bearing surfaces. The grease is sealed in with dynamic O-ring seals rotating against a sealing surface with a Vickers hardness of at least 1000 and vibratory burnished to have a surface finish in the range of from 5 to 32 microinches AA. Preferably, the sealing surface is formed on a seal ring interposed between the cone and journal. Preferably the sealing surface comprises a tungsten carbide composite sprayed onto the outside surface of a steel ring which is then welded to a journal.

27 Claims, 1 Drawing Sheet

ROCK BIT

CROSS-REFERENCE TO RELATED APPLICATION

This is a continuation of application Ser. No. 08/259,433, filed Jun. 14, 1994, abandoned.

BACKGROUND

This invention relates to surfaces that engage a dynamic O-ring seal for retaining the lubricant around the journal bearings in a rock bit for drilling oil wells or the like.

Heavy-duty rock bits are employed for drilling wells in subterranean formations for oil, gas, geothermal steam, mining, blasting and the like. Such bits have a body connected to a drill string and a plurality, typically three, of hollow cutter cones mounted on the body for drilling rock formations. The cutter cones are mounted on steel journals or pins integral with the bit body at its lower end. In use, the drill string and bit body are rotated in the bore hole, and each cone is caused to rotate on its respective journal as the cone contacts the bottom of the bore hole being drilled.

While such a rock bit is used in hard, tough formations, high pressures and temperatures are encountered. The total useful life of a rock bit in such severe environments is in the order of 20 to 200 hours for bits in sizes of about 6½ to 12¼ inch diameter at depths of about 5000 to 20,000 feet. Useful lifetimes of about 65 to 150 hours are typical.

When a rock bit wears out or fails as a bore hole is being drilled, it is necessary to withdraw the drill string for replacing the bit. The time required to make a round trip for replacing a bit is essentially lost from drilling operations. This time can become a significant portion of the total time for completing a well, particularly as the well depths become great. It is therefore quite desirable to maximize the lifetime of a drill bit in a rock formation. Prolonging the time of drilling minimizes the lost time in "round tripping" the drill string for replacing bits.

Replacement of a drill bit can be required for a number of reasons, including wearing out or breakage of the structure contacting the rock formation. One reason for replacing the rock bits includes failure or severe wear of the journal bearings on which the cutter cones are mounted. These bearings are subject to very high pressure drilling loads, high hydrostatic pressures in the hole being drilled, and high temperatures due to drilling, as well as elevated temperatures in the formation being drilled. Considerable development work has been conducted over the years to produce bearing structures and to employ materials that minimize wear and failure of such bearings.

The journal bearings are lubricated with grease adapted to such severe conditions. Such lubricants are a critical element in the life of a rock bit and considerable work has been done to improve such greases.

One of the consistent problems in rock bits is inconsistency of lifetime. Sometimes bits last for long periods, whereas bits which are apparently identical operated under similar conditions may fail with a short lifetime. One cause of erratic lifetime is failure of the dynamic seal that retains lubricant in the bearing. Lubricant may be lost if the seal fails, or abrasive particles of rock may work their way into the bearing surfaces, causing excessive wear.

Rock bit O-rings are being called on to perform service in environments which are extremely harsh. Some modern bits are being run at high rotational speeds, for example, 250 RPM for a 7⅞ inch diameter bit, with some 17½ inch diameter bits being operated at speeds up to 325 RPM. Such high rotational speeds impose high surface speeds on the dynamic O-ring seals, sometimes more than 100 meters per minute and often more than 50 meters per minute. This exacerbates the problems of elevated temperature due to frictional heating and slow dissipation of that heat.

It is therefore desirable to provide a consistently reliable dynamic O-ring seal for maintaining the lubricant within rock bits over a long useful life at high operating speeds. Considerable attention has been devoted to the materials employed for the O-rings in a rock bit, but little attention has been given to the gland surfaces against which the O-rings rub during use. Generally speaking, the gland surface has been smooth steel, possibly carburized for greater hardness.

BRIEF SUMMARY OF THE INVENTION

There is, therefore, provided in practice of this invention according to a presently preferred embodiment, a rock bit for drilling subterranean formations, with improved dynamic O-ring seals for retaining lubricant around the rock bit bearings. Such a rock bit comprises a plurality of journal pins, each having a bearing surface, and a cutter cone mounted on each journal pin and including a bearing surface. A pressure-compensated grease reservoir is in communication with such bearing surfaces for maintaining a grease adjacent to the bearing surfaces. The grease is sealed in with dynamic O-ring seals comprising an elastomeric O-ring and a stationary sealing surface adjacent to the O-ring having a surface hardness greater than Vickers 1000 and a surface finish smoother than 32 microinch AA. Preferably, the sealing surface is on a seal ring interposed between the journal and cone, commonly secured to the journal.

BRIEF DESCRIPTION OF THE DRAWINGS

A rock bit containing such an O-ring seal is illustrated in semi-schematic perspective in FIG. 1 and in a partial cross-section in FIG. 2.

DETAILED DESCRIPTION

A rock bit employing an O-ring seal comprises a body 10 having three cutter cones 11 mounted on its lower end. A threaded pin 12 is at the upper end of the body for assembly of the rock bit onto a drill string for drilling oil wells or the like. A plurality of tungsten carbide inserts 13 are pressed into holes in the surfaces of the cutter cones for bearing on the rock formation being drilled. Nozzles 15 in the bit body introduce drilling mud into the space around the cutter cones for cooling and carrying away formation chips drilled by the bit.

Figure 1:
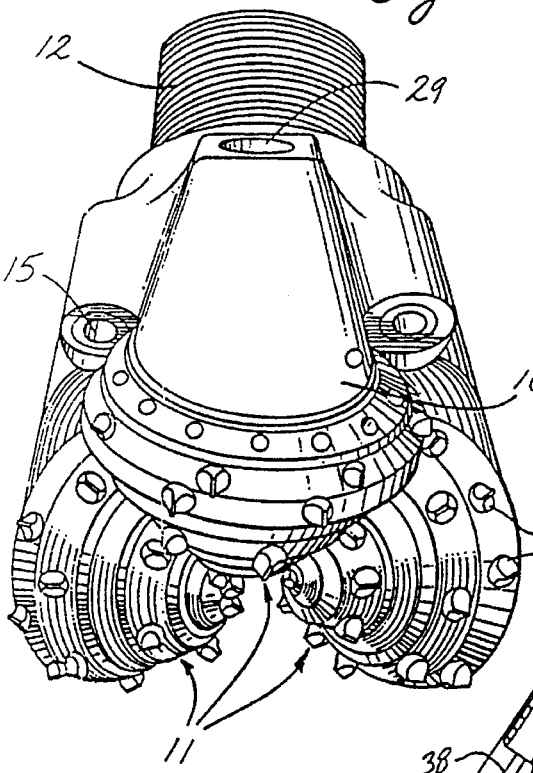
Figure 2:
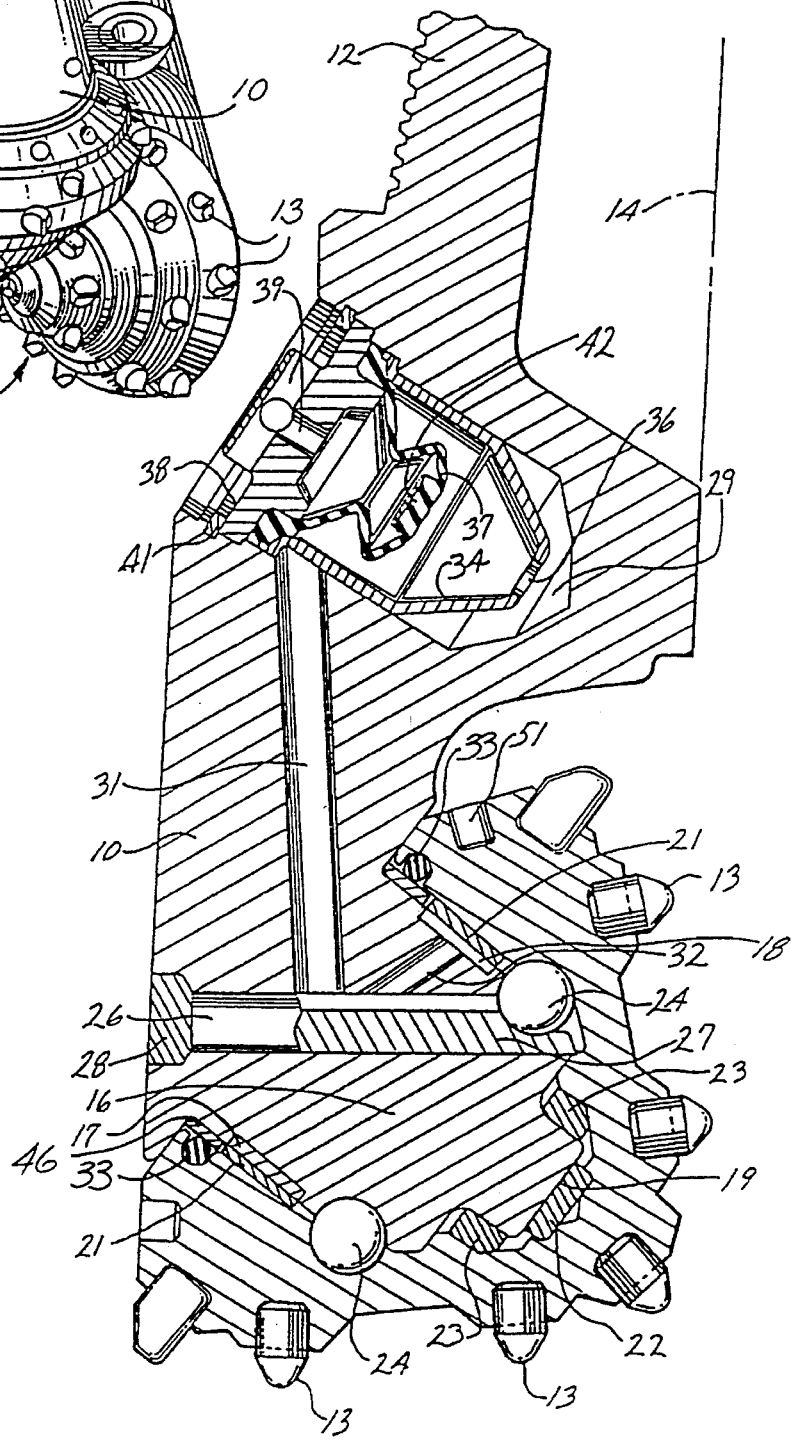

FIG. 2 is a fragmentary, longitudinal cross-section of the rock bit, extending radially from the rotational axis 14 of the rock bit through one of the three legs on which the cutter cones 11 are mounted. Each leg includes a journal pin 16 extending downwardly and radially inwardly on the rock bit body. The journal pin includes a cylindrical bearing surface having a hard metal insert 17 on a lower portion of the journal pin. The hard metal insert is typically a cobalt or iron-base alloy welded in place in a groove on the journal leg and having a substantially greater hardness than the steel forming the journal pin and rock bit body. An open groove 18 is provided on the upper portion of the journal pin. Such a groove may, for example, extend around 60% or so of the circumference of the journal pin, and the hard metal 17 can extend around the remaining 40% or so. The journal pin also has a cylindrical nose 19 at its lower end.

Each cutter cone 11 is in the form of a hollow, generally-conical steel body having tungsten carbide inserts 13 pressed into holes on the external surface. For long life, the inserts may be tipped with a polycrystalline diamond layer. Such tungsten carbide inserts provide the drilling action by engaging a subterranean rock formation as the rock bit is rotated. Some types of bits have hard-faced steel teeth milled on the outside of the cone instead of carbide inserts.

The cavity in the cone contains a cylindrical bearing surface including an aluminum bronze insert 21 deposited in a groove in the steel of the cone or as a floating insert in a groove in the cone. The aluminum bronze insert 21 in the cone engages the hard metal insert 17 on the leg and provides the main bearing surface for the cone on the bit body. A nose button 22 is between the end of the cavity in the cone and the nose 19 and carries the principal thrust loads of the cone on the journal pin. A bushing 23 surrounds the nose and provides additional bearing surface between the cone and journal pin.

Other types of bits, particularly for higher rotational speed applications, have roller bearings instead of the exemplary journal bearings illustrated herein.

A plurality of bearing balls 24 are fitted into complementary ball races in the cone and on the journal pin. These balls are inserted through a ball passage 26, which extends through the journal pin between the bearing races and the exterior of the rock bit. A cone is first fitted on the journal pin, and then the bearing balls 24 are inserted through the ball passage. The balls carry any thrust loads tending to remove the cone from the journal pin and thereby retain the cone on the journal pin. The balls are retained in the races by a ball retainer 27 inserted through the ball passage 26 after the balls are in place. A plug 28 is then welded into the end of the ball passage to keep the ball retainer in place.

The bearing surfaces between the journal pin and cone are lubricated by a grease composition. Preferably, the interior of the rock bit is evacuated, and grease is introduced through a fill passage (not shown). The grease thus fills the regions adjacent the bearing surfaces plus various passages and a grease reservoir, and air is essentially excluded from the interior of the rock bit. The grease reservoir comprises a cavity 29 in the rock bit body, which is connected to the ball passage 26 by a lubricant passage 31. Grease is retained in the bearing structure by a resilient seal in the form of an O-ring 33 between the cone and journal pin. Preferably, the O-ring is in a slightly V-shaped groove.

A pressure compensation subassembly is included in the grease reservoir 29. This subassembly comprises a metal cup 34 with an opening 36 at its inner end. A flexible rubber bellows 37 extends into the cup from its outer end. The bellows is held in place by a cap 38 with a vent passage 39. The pressure compensation subassembly is held in the grease reservoir by a snap ring 41.

When the rock bit is filled with grease, the bearings, the groove 18 on the journal pin, passages in the journal pin, the lubrication passage 31, and the grease reservoir on the outside of the bellows 37 are filled with grease. If the volume of grease expands due to heating, for example, the bellows 37 is compressed to provide additional volume in the sealed grease system, thereby preventing accumulation of excessive pressures. High pressure in the grease system can damage the O-ring seal 33 and permit drilling mud or the like to enter the bearings. Conversely, if the grease volume should contract, the bellows can expand to prevent low pressures in the sealed grease systems, which could cause flow of abrasive and/or corrosive substances past the O-ring seal.

The bellows has a boss 42 at its inner end which can seat against the cap 38 at one end of the displacement of the bellows for sealing the vent passage 39. The end of the bellows can also seat against the cup 34 at the other end of its stroke, thereby sealing the opening 36. If desired, a pressure-relief check valve can also be provided in the grease reservoir for relieving over-pressures in the grease system that could damage the O-ring seal.

A variety of O-ring seals have been employed in such rock bits. Such O-rings typically comprise acrylonitrile polymers or acrylonitrile/butadiene copolymers. Other materials used for dynamic O-ring seals comprise a perfluoroelastomer which has resistance to chemical attack, thermal stability at elevated temperature, and a low coefficient of friction. Suitable O-rings are manufactured from Kalrez perfluoroelastomer resins available from E. I. DuPont de Nemours & Co., Wilmington, Del. Other O-rings are made from highly saturated nitrile rubber or carboxylated elastomers. O-rings may be coated or uncoated.

The O-ring in the rock bit is adjacent to a stationary sealing surface, preferably on a seal ring 46 placed on the journal and welded or otherwise bonded in place. The sealing surface has a Vickers hardness of at least 1000 and a surface finish smoother than 32 microinches AA and preferably less than 20 microinches AA. The sealing surface is burnished by vibratory finishing to have a random lay of surface roughness and what appears to be a matte finish, rather than a shiny finish.

When a seal surface is being formed, the material is machined to approximately the final dimension and ground to a final dimension and surface roughness. After vibratory finishing grinding marks are obliterated and the surface roughness has a random lay. Vibratory finishing does not typically obliterate machining marks, but it does reduce the differences between the peaks and valleys of the surface. An amount of waviness remains. Such waviness is not a problem and may actually act as a helpful lubricant reservoir. In an exemplary embodiment about 20 waves were recorded in 50 mils (1¼ mm) of travel of a profilometer stylus.

Instead of vibratory finishing the surface may be smoothed by shot peening. Shot peening tends to obliterate machining waviness as well as grinding marks. Any remaining roughness has a random lay. Shot peening has been shown to increase service life of a seal by 50%.

Vickers hardness is also known as diamond pyramid hardness. An exemplary Vickers microhardness test employs a diamond pyramid indenter with a 300 gram load (ASTM E384-84. The designation AA microinches means the arithmetic average of measured roughness, typically with a roughness-width cutoff of at least 0.03 inch, and is a conventional measure of surface roughness.

Surprisingly, it is found that the lifetime of the O-ring seal in a rock bit is improved by operating the O-ring against a surface having a hardness higher than is typically available on steel. Previously, sealing surfaces in rock bits have employed hardened steel with a carburized, boronized, nitrided or carbonitrided surface. These case-hardened steel surfaces provide a maximum Vickers hardness in the order of 800, although more commonly the surface hardness is in the order of 600–700. It is found in practice of this invention that a very much harder surface is desirable for enhancing lifetime of a seal. Improvements in lifetime of 50% or more may be achieved as compared with a carburized seal surface.

To obtain such a high hardness on the seal surface, materials other than steel must be used. A suitable material comprises a cemented tungsten carbide composite. A composite having a sufficient hardness comprises tungsten carbide with a chromium-nickel binder having 20% by weight chromium, 7% by weight nickel, and 6% by weight carbon, the balance being tungsten. Such a material is available from Praxair Surface Technologies, Inc., Indianapolis, Ind., as their material SDG 2005. Other SDG 2000 series coatings may also be used.

A hard layer as the sealing surface may be deposited on a steel substrate by flame spraying, arc plasma spraying, detonation gun (D-Gun) or the like. Chemical vapor deposition, plasma assisted vapor deposition or reactive vapor deposition may also be suitable. Deposition by Praxair with a so-called Super D-Gun yields a high density deposited coating. Other suitable materials include tungsten carbide cemented with from 6% to 15% cobalt or nickel. Other materials include metal carbides such as titanium carbide, tantalum carbide, chromium carbide, or ceramics such as silicon carbide, aluminum oxide, silicon oxide chromium oxide or the like. The carbides are generally preferred over oxides since the latter have a relatively lower strength, the strain-to-failure being ⅓ to ½ of the strain-to-failure for carbides. A particularly preferred material comprises a tungsten-chromium-nickel-carbon composite deposited by detonation gun.

Carbides are also preferred over oxides since they generally have higher thermal conductivity. The dynamic seal of a rock bit is often subjected to elevated temperatures and has appreciable heat generated at the interface between the O-ring and the dynamic sealing surface. Good thermal conductivity is desirable for rapidly dissipating the heat and minimizing elevated temperatures at the surface of the O-ring.

When such materials are deposited by spraying, they have a relatively rough surface finish, typically in the order of 100 to 150 microinch AA. Previously, it has been considered adequate to polish a sealing surface for an O-ring in a rock bit to a surface finish less than about 45 microinch AA. It has been discovered, however, that substantially greater O-ring life is achieved by polishing, shot peening or vibratory burnishing the sealing surface to have a finish smoother than 32 microinches AA, and preferably a roughness in the range of from 5 to 15 microinches AA. Such measurements of surface roughness are made with a profilometer, which in the case of the data mentioned herein had a pyramid shaped stylus with a two micron point.

When the sealing surface is made of hardened steel, shot peening is a desirable technique for producing the desired surface smoothness. It is also found that a surface roughness in the range of from 10 to 15 microinches AA is preferred for steel. When the surface is a harder material such as Super D-Gun deposited tungsten carbide composite, a surface roughness of from 5 to 10 microinches AA is preferred.

Surprisingly, it is found that a surface that is polished or burnished to be too smooth actually reduces the life of an O-ring seal. When the surface roughness was reduced to about 1 to 2 microinches AA, seal lifetime was reduced. It is theorized that with an extremely smooth surface, the O-ring may approach the sealing surface so closely that van der Waals forces cause sticking and stick-slip erosion of the O-ring and/or sealing surface.

It is also theorized that in the event the sealing surface is too smooth, it may not be possible to retain a thin film of lubricant between the O-ring and the sealing surface. During normal operation of the dynamic seal in a rock bit, some of the grease from within the bit is believed to be present between the O-ring and sealing surface, thereby minimizing shear forces between the O-ring and sealing surface, reducing frictional heating, and maintaining a physical separation between at least portions of the O-ring and the sealing surface, all of which contribute to enhanced lifetime of the seal. Vibratory finishing which leaves minute random lay and a matte finish on the surface is believed to retain lubricant for maintaining a hydrodynamic film on all or most of the dynamic surface of the seal.

Thus, it is desirable that the sealing surface be polished or burnished by vibratory finishing or similar barrel finishing. In vibratory finishing, the work piece, a finishing medium, water and optionally burnishing compound, are subjected to gyratory vibration in a large vessel. The finishing medium typically comprises small ceramic shapes which have a hardness at least as great as the hardness of the surface being burnished. The ceramic burnishing medium may have any of a broad variety of shapes, including spheres, spheroids, discs, rectangular plates, triangular prisms, stars, cylinders, or the like. The burnishing compound typically includes surfactants and very fine abrasive suspended in the water. Abrasive is not normally used when finishing the sealing surface.

A preferred ceramic finishing medium comprises what are called three pointed stars. They are flat, triangular pieces of ceramic with the edges between the points of the triangle somewhat recessed or concave. It is found that this burnishing medium leaves a matte finish on the surface when it is burnished to a roughness in the range of from 5 to 32 microinches AA. Pyramid shaped burnishing medium can be used to obtain low roughness, but it does not produce the desired a matte finish. Ceramic ball burnishing medium makes the surface shiny, but doesn't decrease surface roughness much. A surface that appears shiny may still have greater roughness than desired.

Constant agitation of the mixture in the vibratory vessel circulates the medium, compound and parts being finished to produce a scrubbing action that moves across the workpiece surfaces in random directions. The merit of the vibratory finishing is that any residual directional lay of the surface roughness due to prior machining or grinding operations, is effectively obliterated. As has been mentioned, this treatment smooths roughness, not waviness of machining. After vibratory burnishing, the lay of the surface is random. As has been mentioned, vibratory finishing or shot peening should not be continued so long that the surface roughness is less than about 5 microinches AA.

The hard material forming the sealing surface is preferably deposited on a steel substrate. The thickness of the hard coating should be at least two mils (50 micrometers), and preferably about four mils (100 micrometers). During the operation of a rock bit, the motion of the compressed O-ring across the sealing surface (or vice versa) applies a substantial shear force at the surface. Appreciable thickness of the coating is required for diminishing the shear force at the interface between the substrate and coating. Otherwise, the shear force might exceed the shear strength of the bond between the coating and substrate and result in delamination.

There is no uniform upper limit to the thickness of the deposited coating except that it must be accommodated in the space available for the seal of the rock bit. Typically, the thickness of the coating is less than ten mils since thicker coatings are not needed and are costly. An entire seal ring may be made of hard material instead of forming a deposit on a steel ring for forming the sealing surface. However, the hard materials generally tend to be more brittle than steel and may not be able to reliably withstand the stresses applied in a rock bit.

Typically, during operation of a rock bit, the O-ring between the cone and journal rotates with the cone. In other words, there is a static seal between the O-ring and the cone, and a dynamic seal between the O-ring and the journal. In such an embodiment, the smooth sealing surface with high hardness is formed on the journal.

The seal may, however, be designed so that the O-ring remains fixed relative to the journal, and the cone rotates relative to the O-ring. In such an embodiment, the hard, smooth sealing surface is provided within the cone.

There are a number of practical difficulties in providing the sealing surface on either the journal at the end of each leg of a rock bit or inside the rotatable cone. Deposition, grinding and burnishing all present manufacturing problems. It is, therefore, preferred to employ a coated seal ring 46. The seal ring is preferably placed on the journal and secured in place, such as by laser or electron-beam welding. Adhesive bonding may also be used. Although a dynamic seal on the inside diameter of the O-ring is preferred, it is also feasible to insert a seal ring in the cone and employ a dynamic seal on the outside diameter of an O-ring.

A rock bit with the preferred sealing surface can be made as follows: the legs and cones of a rock bit are forged, machined, welded and heat treated in substantially the same way as is conventionally done. A steel ring is separately manufactured and heat treated to a hardness of about 38 to 42 Rockwell C. A hard surface coating, such as a tungsten carbide composite, is deposited on the outside diameter of the seal ring by the Super D-gun technique or the like. The sealing surface of the coating is ground with a fine diamond abrasive to substantially its final dimension. The ring is then vibratory finished so that the sealing surface has a roughness in the range of from 5 to 10 microinches AA. Such a ring is placed on a journal of the rock bit and at least spot welded in place with a laser beam. A cone with an O-ring in place is then assembled on the journal and the assembly of the bit is completed in a conventional manner.

A sealing surface as provided in practice of this invention significantly increases the lifetime of an O-ring seal. For example, in a conventional O-ring seal, the sealing surface of steel carburized and heat treated to a hardness of about 55 Rockwell C has a lifetime in a standardized test in the order of about 25 hours or less. At the end of this time, pitting and wear grooves can be seen on the steel surface. A polished sealing surface formed of the SDG 2005 material has a lifetime of about 50 hours in a similar test. When such a surface is vibratory burnished to a surface roughness in the order of 6 to 9 microinches AA, the lifetime is further increased to about 75 hours. Furthermore, there is a significant decrease in variability of resistance torque from the seal surface. In the absence of vibratory burnishing there is usually a start-up torque spike and often one to several unexplained torque spikes throughout a test. After vibratory finishing there are no more unexplained torque spikes during a test, and the start up torque spike is nearly eliminated.

It is also found that vibratory finishing or shot peening to a surface finish less than 32 microinches AA is beneficial for carburized steel sealing surfaces which have a Vickers hardness less than 1000. Unexplained torque spikes during testing are virtually eliminated.

Although limited embodiments of rock bit have been described herein, many modifications and variations will be apparent to those skilled in the art. The exemplary bit described and illustrated is no more than that; there are a variety of bit configurations known in which a hard, smooth sealing surface may be used. Furthermore, variations may be made in the composition of the surface beyond the specific materials mentioned. The sealing surface may also be deposited by chemical vapor deposition, plasma-assisted chemical vapor deposition, or the like, as well as the spraying techniques described above. It is therefore to be understood that, within the scope of the appended claims, this invention may be practiced otherwise than as specifically described.

What is claimed is:

1. A rock bit for drilling subterranean formations comprising:

a bit body including a plurality of journal pins, each journal pin having a bearing surface;

a cutter cone mounted on each journal pin and including a bearing surface;

a pressure-compensated grease reservoir in communication with such bearing surfaces;

a grease in the grease reservoir and adjacent the bearing surfaces;

an elastomeric O-ring seal between the journal pin and the cone for retaining the grease in the bearing; and a stationary sealing surface adjacent to the O-ring seal having a sealing surface with a Vickers hardness of at least 1000 and a surface finish in the range of from 5 to 32 microinches AA.

2. A rock bit as recited in claim 1 wherein the sealing surface is formed on a seal ring interposed between the cone and journal.

3. A rock bit as recited in claim 2 wherein the seal ring is mounted on the journal.

4. A rock bit as recited in claim 2 wherein the seal ring is formed of steel with a surface layer of material selected from the group consisting of tungsten carbide, titanium carbide, tantalum carbide, chromium carbide, silicon carbide, silicon oxide, aluminum oxide and chromium oxide.

5. A rock bit as recited in claim 4 wherein the surface layer comprises tungsten-chromium-nickel-carbon composite.

6. A rock bit as recited in claim 1 wherein the surface finish is in the range of from 5 to 10 microinches AA.

7. A rock bit as recited in claim 1 wherein the surface finish is on a layer having a thickness of at least two mils over a steel substrate.

8. A rock bit as recited in claim 1 wherein the surface layer comprises a material deposited on a steel substrate by a method selected from the group consisting of detonation spraying, plasma spraying, flame spraying, chemical vapor deposition, and plasma assisted chemical vapor deposition.

9. A rock bit as recited in claim 8 wherein the surface layer comprises a material deposited by detonation spraying.

10. A rock bit for drilling subterranean formations comprising:

a bit body including a plurality of journal pins, each journal pin having a bearing surface;

a cutter cone mounted on each journal pin and including a bearing surface;

a pressure-compensated grease reservoir in communication with such bearing surfaces;

a grease in the grease reservoir and adjacent the bearing surfaces;

an elastomeric O-ring seal between the journal pin and the cone for retaining the grease in the bearing; and a stationary sealing surface adjacent to the O-ring seal having a sealing surface burnished to have a random lay of surface roughness and a surface roughness smoother than 32 microinches AA.

11. A rock bit as recited in claim 10 wherein the sealing surface is formed on a seal ring interposed between the cone and journal.

12. A rock bit as recited in claim 10 wherein the sealing surface has a surface roughness less than 20 microinches.

13. A rock bit as recited in claim 12 wherein the sealing surface has a matte finish.

14. A rock bit as recited in claim 10 wherein the seal ring is formed of steel with a surface layer of material selected from the group consisting of tungsten carbide, titanium carbide, tantalum carbide, chromium carbide, silicon carbide, aluminum oxide and chromium oxide.

15. A rock bit as recited in claim 14 wherein the surface layer comprises a tungsten-chromium-nickel-carbon composite.

16. A rock bit as recited in claim 10 wherein the sealing surface comprises a tungsten-chromium-nickel-carbon composite.

17. A rock bit as recited in claim 10 wherein the surface finish is in the range of from 5 to 10 microinches AA.

18. A rock bit as recited in claim 10 wherein the surface finish is on a surface layer having a thickness of at least two mils over a steel substrate.

19. A rock bit as recited in claim 10 wherein the surface layer comprises a material deposited on a steel substrate by a method selected from the group consisting of detonation spraying, plasma spraying, flame spraying, chemical vapor deposition, and plasma assisted chemical vapor deposition.

20. A rock bit as recited in claim 10 wherein the Vickers hardness of the surface is greater than 1000 and the surface finish is in the range of from 5 to 10 microinches AA.

21. A rock bit as recited in claim 10 wherein the sealing surface is steel and the surface finish is in the range of from 10 to 15 microinches AA.

22. A rock bit for drilling subterranean formations comprising:

a bit body including a plurality of journal pins, each journal pin having a bearing surface;

a cutter cone mounted on each journal pin and including a bearing surface;

a pressure-compensated grease reservoir in communication with such bearing surfaces;

a grease in the grease reservoir and adjacent the bearing surfaces;

an elastomeric O-ring seal between the journal pin and the cone for retaining the grease in the bearing; and a stationary seal ring adjacent to the O-ring seal having a sealing surface with a Vickers hardness of at least 1000 and a surface finish smoother than 32 microinches AA.

23. A rock bit as recited in claim 22 wherein the surface finish is in the range of from 5 to 10 microinches AA.

24. A rock bit as recited in claim 22 wherein the surface finish is on a layer having a thickness of at least two mils over a steel substrate.

25. A rock bit as recited in claim 22 wherein the surface layer comprises a material deposited on a steel substrate by a method selected from the group consisting of detonation spraying, plasma spraying, flame spraying, chemical vapor deposition and plasma assisted chemical vapor deposition.

26. A rock bit as recited in claim 22 wherein the sealing surface comprises a tungsten-chromium-nickel-carbon composite.

27. A rock bit as recited in claim 26 wherein the surface layer comprises a material deposited by detonation spraying.

* * * * *